US007216451B1

(12) United States Patent
Troy

(10) Patent No.: US 7,216,451 B1
(45) Date of Patent: May 15, 2007

(54) MODULAR HAND GRIP AND RAIL ASSEMBLY FOR FIREARMS

(76) Inventor: Stephen P. Troy, 289 Chanterwood, Lee, MA (US) 01238

( * ) Notice: Subject to any disclaimer, the term of this patent is extended or adjusted under 35 U.S.C. 154(b) by 0 days.

(21) Appl. No.: 11/351,822

(22) Filed: Feb. 10, 2006

Related U.S. Application Data

(60) Provisional application No. 60/652,035, filed on Feb. 11, 2005.

(51) Int. Cl.
*F41C 23/00* (2006.01)

(52) U.S. Cl. ..... 42/72; 42/71.01

(58) Field of Classification Search ..... 42/114, 42/115, 116, 117, 124, 142, 143, 146, 72, 42/71.01, 75.01; 89/1.42
See application file for complete search history.

(56) References Cited

U.S. PATENT DOCUMENTS 5,343,650 A * 9/1994 Swan ..... 42/117
5,590,484 A 1/1997 Mooney et al.
6,490,822 B1 12/2002 Swan
6,499,245 B1 12/2002 Swan
6,618,976 B1 * 9/2003 Swan ..... 42/114
6,655,069 B2 * 12/2003 Kim ..... 42/114
6,779,288 B1 * 8/2004 Kim ..... 42/72
6,792,711 B2 9/2004 Battaglia
6,839,998 B1 1/2005 Armstrong
7,059,076 B2 6/2006 Stoner et al.
2003/0230022 A1 12/2003 Battaglia
2004/0000083 A1 1/2004 Grant, Jr.

* cited by examiner

*Primary Examiner*—Michael J. Carone
*Assistant Examiner*—Benjamin P. Lee
(74) *Attorney, Agent, or Firm*—Parsons & Goltry; Robert A. Parsons; Michael W. Goltry

(57) ABSTRACT

A modular hand grip for use on a firearm, the modular hand grip includes an upper portion, a lower portion and a coupling assembly. A rearward end of the upper portion is configured to engage a top portion of a barrel nut. Lug rails having gaps therein project from an inner surface of the upper portion at opposing sides and proximate edges thereof. The coupling assembly is engagable with a bottom portion of the barrel nut and is attached to the rearward end of the upper portion. The lower portion has opposing side sections, each terminating at an edge. A plurality of spaced apart lugs extend from each edge and are receivable in the gaps in the lug rails of the upper portion and are translatable in one of a forward direction and a rearward direction positioning the lugs under the lug rails.

13 Claims, 5 Drawing Sheets

MODULAR HAND GRIP AND RAIL ASSEMBLY FOR FIREARMS

CROSS-REFERENCE TO RELATED APPLICATION

This application claims the benefit of U.S. Provisional Application No. 60/652,035, filed 11 Feb. 2005.

FIELD OF THE INVENTION

This invention relates to firearms accessories.

More particularly, the present invention relates to hand grip and rail accessories.

BACKGROUND OF THE INVENTION

It is understood that hand-held firearms require some type of handgrip so that the operator can hold the firearm as it is fired. Also, many accessories are available that aid in the proper and/or enhanced operation of firearms and some type of platform or mounting structure is generally provided or available as an accessory for this function. Several problems are prevalent in the firearms industry with respect to hand grip and rail assemblies. Many firearms are operated as automatic or semiautomatic and have a tendency to heat extensively so that handgrips attached directly to the barrel can produce hand burns for the operator if great care is not taken. In addition, anything attached directly to the barrel of a firearm can have a tendency to alter the barrel slightly and any alterations can adversely affect the accuracy of the firearm.

It would be highly advantageous, therefore, to remedy the foregoing and other deficiencies inherent in the prior art.

Accordingly, it is an object the present invention to provide a new and improved hand grip for a firearm.

Another object of the present invention is to provide a handgrip which is not attached to the barrel of a firearm.

And another object of the present invention is to provide a hand grip which can be utilized with existing firearms, and specifically with conventional barrel nuts.

SUMMARY OF THE INVENTION

Briefly, to achieve the desired objects of the present invention in accordance with a preferred embodiment thereof, provided is a modular hand grip for use on a firearm and for engaging a barrel nut of the firearm. The barrel nut includes a cylindrical portion terminating at a forwardly directed end with a radially outwardly directed flange. The hand grip includes an upper portion having a forward end, a rearward end, an inner surface and an outer surface. A groove is formed in the inner surface of the upper portion perpendicular to a longitudinal axis thereof, and spaced from the rearward end. The groove receives the flange of the barrel nut to align the upper portion and to prevent longitudinal movement thereof. A coupling assembly engages a bottom portion of the barrel nut and is attached to the rearward end of the upper portion. A lower portion is also provided and includes a top section and opposing side sections extending therefrom, each terminating at an edge coupled to the upper portion.

In a further aspect of the present invention the upper portion further includes lug rails projecting from the inner surface at opposing sides and proximate edges thereof. The lug rails extend longitudinally from proximate the forward end to a position proximate the rearward end and include a plurality of gaps formed therein. The lower portion further includes a plurality of spaced apart lugs extending from each edge thereof and receivable in the gaps in the lug rails of the upper portion. The lugs, and thus the lower portion, is translatable in one of a forward direction and a rearward direction positioning the lugs under the lug rails In yet another aspect of the present invention, a detent assembly is carried by the clamp element for engaging the lower portion. The detent assembly includes a plunger detent biased outwardly from a central portion of the clamping element and received in an aperture formed through a rearward end of the top section when the lugs are positioned under the lug rails.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
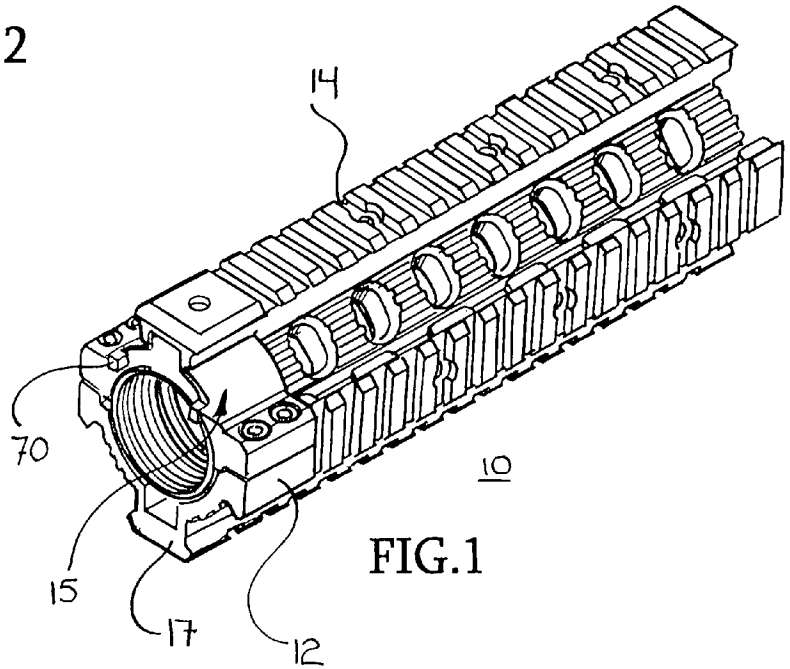
FIG. 1 is a perspective view of a modular hand grip assembly according to the present invention.
Figure 2:
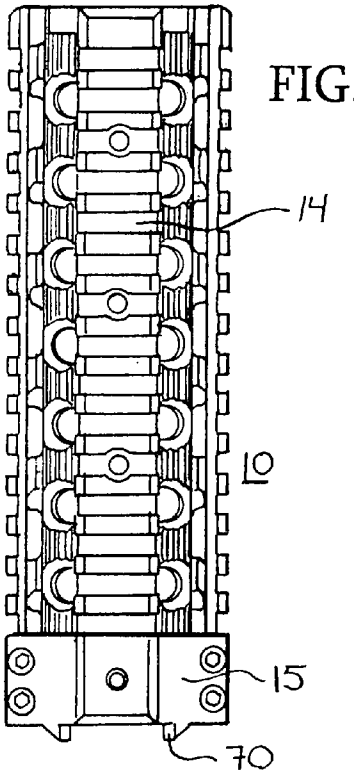
FIG. 2 is a bottom plan view of the modular hand grip assembly of FIG. 1.
Figure 3:
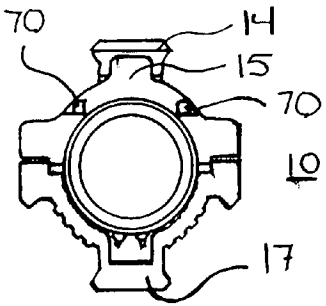
FIG. 3 is an end view of the modular hand grip of FIGS. 1 and 2.

Turning now to the drawings in which like reference characters indicate corresponding elements throughout the several views, attention is directed to FIGS. 1–3 which illustrate a modular hand grip according to the present invention, generally designated 10. Modular hand grip 10 includes three main elements, an upper portion 12, a lower portion 14, and a coupling assembly 15. Upper portion 12 can, and preferably does include a rail 17 provided to permit the coupling of additional accessory devices. Modular hand grip 10 is removably coupled to the fore-end of a firearm, providing a grip, rail, and rail alignment assembly.

Figure 4:
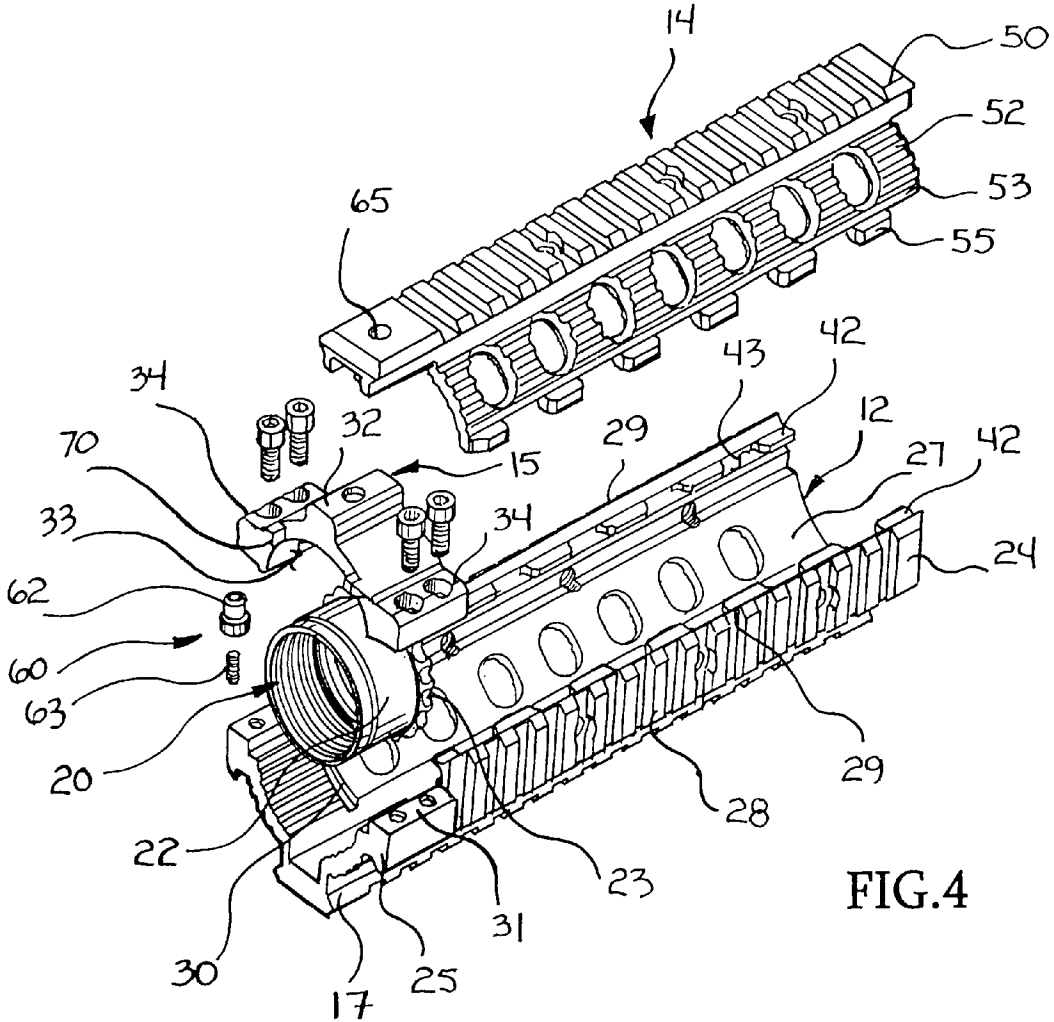
FIG. 4 is an exploded perspective view of the modular hand grip according to the present invention.
Figure 5:
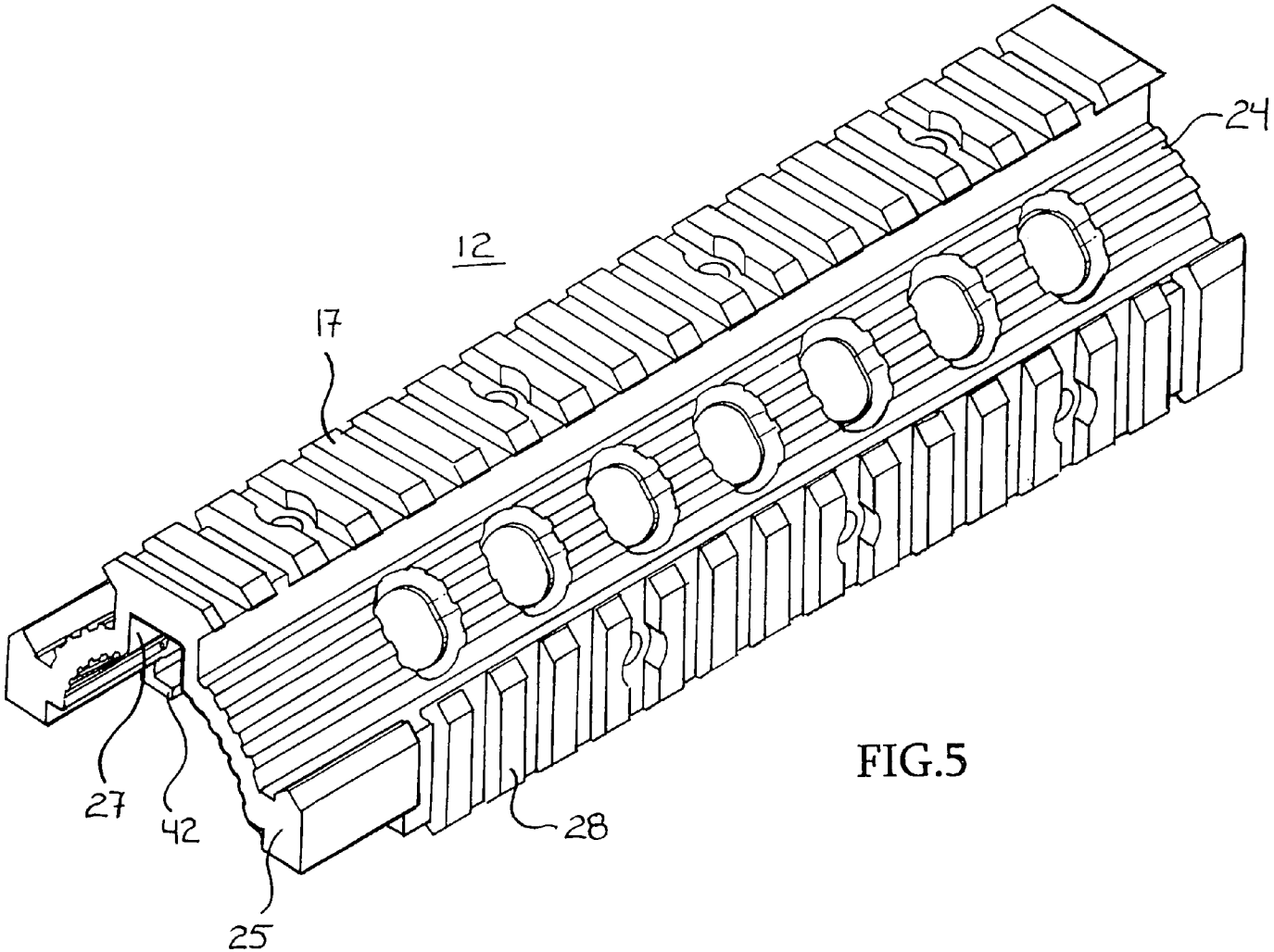
FIG. 5 is a perspective view of an upper portion of the modular hand grip.
Figure 6:
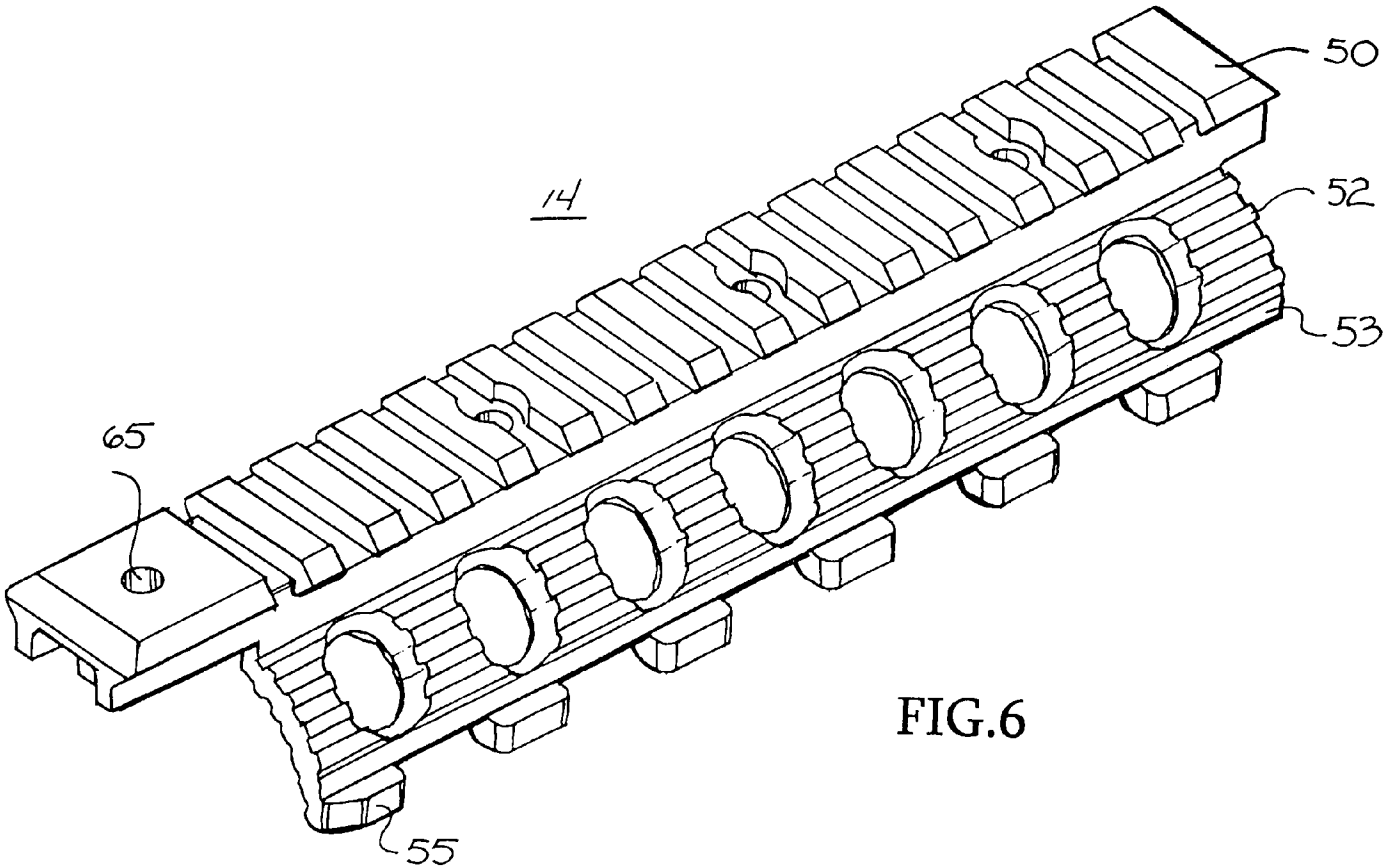
FIG. 6 is a perspective view of the lower portion of the modular hand grip.
Figure 7:
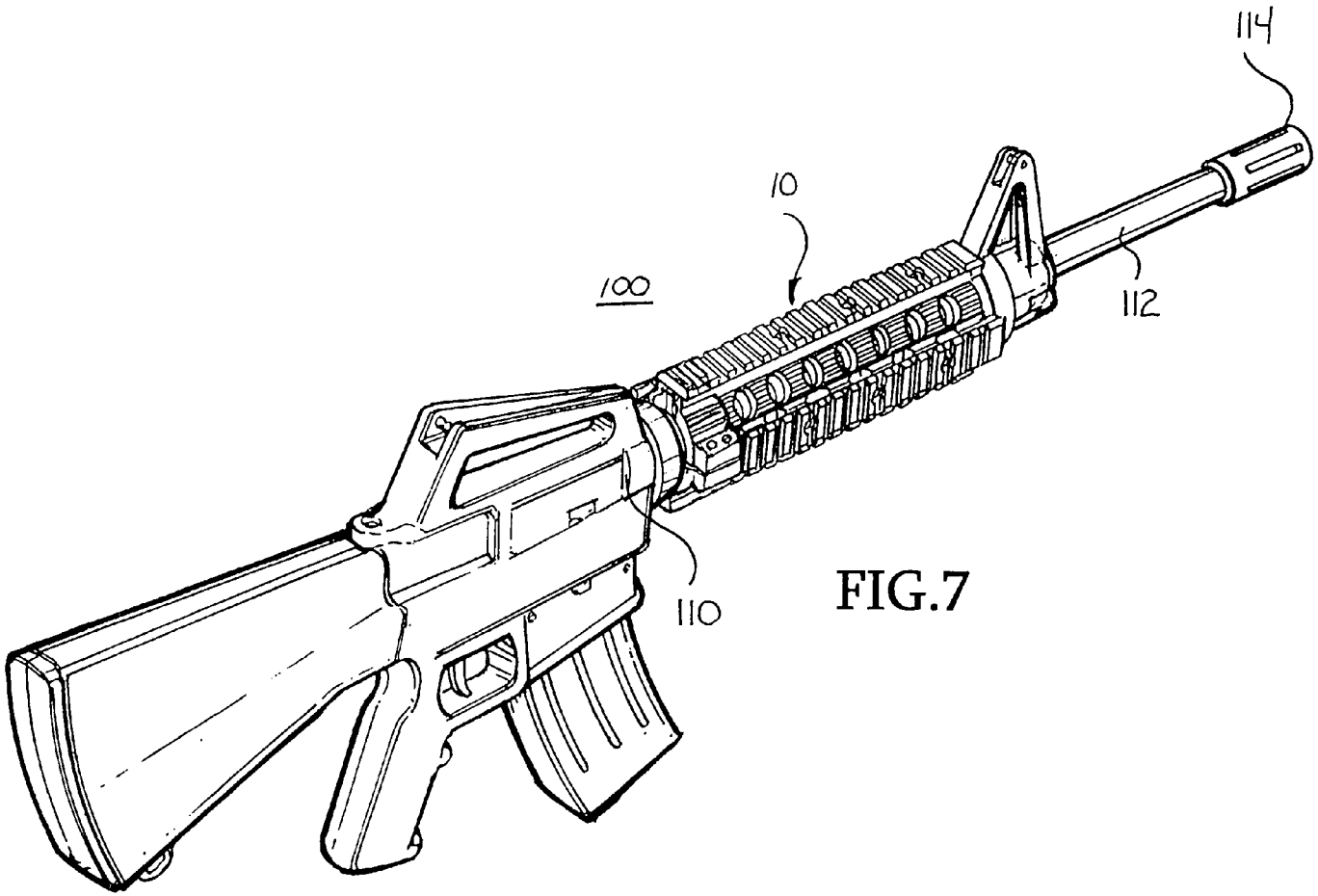
FIG. 7 is a perspective view of a firearm including the modular handgrip of FIGS. 1–6.

With reference to FIGS. 4, 5, and 6, modular hand grip 10 is coupled to a firearm 100 (illustrated in FIG. 7) through engagement with a barrel nut 20. Firearm 100 includes a receiver 110 and a barrel 112. For purposes of this description, the term forwardly is intended to refer to the direction toward a muzzle 114 of firearm 100, and rearwardly is directed toward receiver 110. Barrel 112 is coupled to receiver 110 with barrel nut 20. Barrel nut 20 typically includes a threaded cylindrical portion 22 terminating at a forwardly directed end with a radially outwardly directed flange 23. Upper portion 12 includes a forward end 24, a rearward end 25, an inner surface 27 and an outer surface 28. Upper portion 12 forms a portion of a tubular enclosure terminating in edges 29 and completed by lower portion 14. Upper portion 12 and lower portion 14 encircle barrel 112 of firearm 100 when installed. Rearward end 25 is configured to substantially engage a top portion of barrel nut 20. A groove 30 is formed in inner surface 27 of upper portion 12, perpendicular to a longitudinal axis thereof, and spaced from rearward end 25. Groove 30 is positioned to receive flange 23 of a conventional factory barrel nut such as barrel nut 20. Receipt of barrel nut 20 in groove 30 serves to align upper portion 12 with the rest of firearm 100, (FIG. 7), and longitudinally retain upper portion 12, preventing forward and rearward movement thereof. Upper portion 12 serves as the anchor for modular hand grip 10.

Further securing upper portion 12 to barrel nut 20, is coupling assembly 15. Coupling assembly 15 consists of a clamp element 32 having a central semicircular recess 33 configured to receive cylindrical portion 22 of barrel nut 20, and flanges 34 extending to opposing sides. Clamp element 32 is attached to rearward end 25 of upper portion 12 with fasteners that are inserted through openings in flanges 34 and into threaded holes formed in engagement portions 31 of edges 29 of upper portion 12. Engagement portions 31 are flattened and recessed below edges 29 to accommodate flanges 34. Upper portion 12 is positioned with flange 23 of barrel nut 20 received in groove 30 and secured in position by clamp element 32 positioned around barrel nut 20 and the fasteners installed and tightened into the threaded holes in engagement portions 31 of upper portion 12. When the fasteners are installed and tightened, clamp element 32 and upper portion 12 are drawn together securely engaging barrel nut 20. There can be one or more fasteners per side as desired. The presence of groove 30 acts to automatically align upper portion 12 with the rest of the firearm. Thus, for example, a rail carried by, or formed as, part of upper portion 12 will be aligned with the rail typically present on an upper receiver of the firearm. While adjustments can be made during fabrication, the preferred alignment is intended to match with factory flattop Mil-std 1913 specifications.

Upper portion 12 further includes lug rails 42 extending from opposing sides thereof proximate edges 29. Lug rails 42 extend longitudinally from a forward end 24 to a position proximate groove 30. Lug rails 42 include a plurality of gaps 43 formed therein for purposes which will be discussed presently. Lower portion 14 completes the tubular aspect of modular hand grip 10 when engaged with upper portion 12. Lower portion 14 includes a top section 50 and opposing side sections 52 extending therefrom and terminating at edges 53. A plurality of spaced apart lugs 55 extend from opposing edges 53 and are configured to be received in gaps 43 in lug rails 42 of upper portion 12. Thus, lower portion 14 is coupled to upper portion 12 by properly aligning lower portion 14 and inserting lugs 55 through gaps 43. Lower portion 14 is then translated in a rearward direction locking lugs 55 under lug rails 42. This securely attaches lower portion 14 to upper portion 12 substantially along its entire length. Further translational motion forwardly or reawardly is prevented by a detent assembly 60 as part of the coupling or clamp assembly 15 and carried by clamp element 32.

Detent assembly 60 includes a plunger detent 62 received by a central portion of clamping element 32. Plunger detent 62 is biased outwardly from barrel nut 20, preferably by a compression spring 63. As lower portion 14 is translated rearwardly with lugs 55 engaging upper portion 12 under lug rails 32, an aperture 65 formed through a rearward end of top section 50 aligns with plunger detent 62 which is received therein. With plunger detent 62 received in aperture 65, further translational movement of lower portion 14 is prevented.

With reference to FIGS. 1 and 4, an additional feature of modular hand grip 10 is anti-rotational studs 70 extending from a rearward surface of clamp element 32. Studs 70 engage the receiver of a firearm, and prevent rotation of hand grip 10. Rotation of hand grip 10, since it is attached only to barrel nut 20, can act to unscrew barrel nut 20, rotating barrel nut 20 in a loosening direction, which is highly undesirable. Thus, studs 70 prevent this action by contacting the receiver. One or more studs 70 can be employed. One being sufficient, as loosening of the barrel nut occurs in one rotational direction, preventable by one stud 70. Another stud can be employed to prevent rotation of the barrel nut in a tightening direction if desired. It is also understood that a stud can extend from upper portion 14, lower portion 12 or, as illustrated, clamp 15.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A modular hand grip for use on a firearm, the modular hand grip comprising:

an upper portion having a forward end, a rearward end, an inner surface and an outer surface, the rearward end is configured to engage a top portion of a barrel nut;

lug rails project from the inner surface of upper portion at opposing sides and proximate edges thereof, the lug rails extend longitudinally from proximate the forward end to a position proximate the rearward end and include a plurality of gaps formed therein;

a clamp assembly for engaging a bottom portion of the barrel nut is attached to the rearward end of the upper portion, the clamp assembly includes a clamp element having a central recess configured to receive the barrel nut, and flanges extending to opposing sides and attached to the edges at the rearward end of the upper portion, wherein the flanges are attached to the rearward end with fasteners that are inserted through openings in the flanges and into holes in engagement portions of the edges of the upper portion; and a lower portion having a top section and opposing side sections extending therefrom and each terminating at an edge, a plurality of spaced apart lugs extending from each edge and receivable in the gaps in the lug rails of the upper portion and translatable in one of a forward direction and a rearward direction positioning the lugs under the lug rails.

2. A modular hand grip as claimed in claim 1 wherein a groove is formed in the inner surface of the upper portion, perpendicular to a longitudinal axis thereof, and spaced from the rearward end, to receive the flange of a conventional factory barrel nut.

3. A modular hand grip for use on a firearm, the modular hand grip comprising:

an upper portion having a forward end, a rearward end, an inner surface and an outer surface, the rearward end is configured to engage a top portion of a barrel nut;

lug rails project from the inner surface of upper portion at opposing sides and proximate edges thereof, the lug rails extend longitudinally from proximate the forward end to a position proximate the rearward end and include a plurality of gaps formed therein;

a clamp assembly for engaging a bottom portion of the barrel nut is attached to the rearward end of the upper portion;

a lower portion having a top section and opposing side sections extending therefrom and each terminating at an edge, a plurality of spaced apart lugs extending from each edge and receivable in the gaps in the lug rails of the upper portion and translatable in one of a forward direction and a rearward direction positioning the lugs under the lug rails; and a detent assembly carried by the clamp assembly for engaging the lower portion.

4. A modular hand grip as claimed in claim 3 wherein the detent assembly includes a plunger detent biased outwardly from a central portion of the clamping assembly and received in an aperture formed through a rearward end of the top section when the lugs are positioned under the lug rails.

5. A modular hand grip as claimed in claim 4 wherein the plunger detent is biased outwardly by a compression spring.

6. A modular hand grip for use on a firearm, the modular hand grip comprising:

a barrel nut including a cylindrical portion terminating at a forwardly directed end with a radially outwardly directed flange;

an upper portion having a forward end, a rearward end, an inner surface and an outer surface;

a groove formed in the inner surface of the upper portion, perpendicular to a longitudinal axis thereof, and spaced from the rearward end, the groove receiving the flange of the barrel nut to align the upper portion and to prevent longitudinal movement thereof;

a clamp assembly engaging a bottom portion of the barrel nut and attached to the rearward end of the upper portion, the clamp assembly includes a clamp element having a central semicircular recess receiving the cylindrical portion of the barrel nut, and flanges extending to opposing sides and attached to the edges at the rearward end of the upper portion, wherein the flanges are attached to the rearward end with fasteners that are inserted through openings in the flanges and into holes in engagement portions of the edges of the upper portion; and a lower portion having a top section and opposing side sections extending therefrom and each terminating at an edge coupled to the upper portion.

7. A modular hand grip for use on a firearm, the modular hand grip comprising:

a barrel nut including a cylindrical portion terminating at a forwardly directed end with a radially outwardly directed flange;

an upper portion having a forward end, a rearward end, an inner surface and an outer surface;

a groove formed in the inner surface of the upper portion, perpendicular to a longitudinal axis thereof, and spaced from the rearward end, the groove receiving the flange of the barrel nut to align the upper portion and to prevent longitudinal movement thereof;

a clamp assembly engaging a bottom portion of the barrel nut and attached to the rearward end of the upper portion;

a lower portion having a top section and opposing side sections extending therefrom and each terminating at an edge coupled to the upper portion;

a detent assembly carried by the clamp assembly for engaging the lower portion; and wherein the upper portion further includes lug rails projecting from the inner surface at opposing sides and proximate edges thereof, the lug rails extending longitudinally from proximate the forward end to a position proximate the rearward end and including a plurality of gaps formed therein, and the lower portion further includes a plurality of spaced apart lugs extending from each edge thereof and receivable in the gaps in the lug rails of the upper portion and translatable in one of a forward direction and a rearward direction positioning the lugs under the lug rails.

8. A modular hand grip as claimed in claim 7 wherein the detent assembly includes a plunger detent biased outwardly from a central portion of the clamping assembly and received in an aperture formed through a rearward end of the top section when the lugs are positioned under the lug rails.

9. A modular hand grip as claimed in claim 8 wherein the plunger detent is biased outwardly by a compression spring.

10. A modular hand grip on a firearm comprising:

a firearm having a receiver, a barrel, and a barrel nut including a cylindrical portion terminating at a forwardly directed end with a radially outwardly directed flange, the barrel nut coupling the barrel to the receiver;

an upper portion having a forward end, a rearward end, an inner surface and an outer surface;

a groove formed in the inner surface of the upper portion, perpendicular to a longitudinal axis thereof, and spaced from the rearward end, the groove receiving the flange of the barrel nut to align the upper portion with the receiver and to prevent longitudinal movement thereof;

a clamp assembly engaging a bottom portion of the barrel nut and attached to the rearward end of the upper portion, the clamp assembly includes a clamp element having a central semicircular recess receiving the cylindrical portion of the barrel nut, and flanges extending to opposing sides and attached to the edges at the rearward end of the upper portion, the flanges are attached to the rearward end with fasteners that are inserted through openings in the flanges and into holes in engagement portions of the edges of the upper portion; and a lower portion having a top section and opposing side sections extending therefrom and each terminating at an edge coupled to the upper portion, the upper portion and the lower portion encircling the barrel.

11. A modular hand grip as claimed in claim 10 wherein the upper portion further includes lug rails projecting from the inner surface at opposing sides and proximate edges thereof, the lug rails extending longitudinally from proximate the forward end to a position proximate the rearward end and including a plurality of gaps formed therein, and the lower portion further includes a plurality of spaced apart lugs extending from each edge thereof and receivable in the gaps in the lug rails of the upper portion and translatable in one of a forward direction and a rearward direction positioning the lugs under the lug rails.

12. A modular hand grip on a firearm comprising:

a firearm having a receiver, a barrel, and a barrel nut including a cylindrical portion terminating at a forwardly directed end with a radially outwardly directed flange, the barrel nut coupling the barrel to the receiver;

an upper portion having a forward end, a rearward end, an inner surface and an outer surface;

a groove formed in the inner surface of the upper portion, perpendicular to a longitudinal axis thereof, and spaced from the rearward end, the groove receiving the flange of the barrel nut to align the upper portion with the receiver and to prevent longitudinal movement thereof;

a clamp assembly engaging a bottom portion of the barrel nut and attached to the rearward end of the upper portion; and a lower portion having a top section and opposing side sections extending therefrom and each terminating at an edge coupled to the upper portion, the upper portion and the lower portion encircling the barrel;

the upper portion further includes lug rails projecting from the inner surface at opposing sides and proximate edges thereof, the lug rails extending longitudinally from proximate the forward end to a position proximate the rearward end and including a plurality of gaps formed therein, and the lower portion further includes a plurality of spaced apart lugs extending from each edge thereof and receivable in the gaps in the lug rails of the upper portion and translatable in one of a forward direction and a rearward direction positioning the lugs under the lug rails; and a detent assembly carried by the clamp assembly for engaging the lower portion.

13. A modular hand grip as claimed in claim 12 wherein the detent assembly includes a plunger detent biased outwardly from a central portion of the clamping assembly and received in an aperture formed through a rearward end of the top section when the lugs are positioned under the lug rails.

* * * * *